United States Patent [19]

Fischman et al.

[11] Patent Number: 4,602,187

[45] Date of Patent: Jul. 22, 1986

[54] COLOR CRT WITH COMPOSITE ARC SUPPRESSION STRUCTURE

[75] Inventors: Martin Fischman, Seneca Falls; Anthony V. Gallaro, Auburn, both of N.Y.

[73] Assignee: North American Philips Consumer Electronics Corp., New York, N.Y.

[21] Appl. No.: 625,486

[22] Filed: Jun. 28, 1984

[51] Int. Cl.[4] ..... H01J 29/88; H01J 29/92

[52] U.S. Cl. ..... 313/479; 445/45; 313/477 HC

[58] Field of Search ..... 313/479, 477 HC, 450; 315/3; 427/64; 445/45

[56] References Cited

U.S. PATENT DOCUMENTS

| | | | |
|---|---|---|---|
| 3,802,757 | 4/1974 | Benda et al. | 445/45 X |
| 3,959,686 | 5/1976 | Davis et al. | 313/479 X |
| 4,018,717 | 4/1977 | Francel et al. | 313/479 X |
| 4,124,540 | 11/1978 | Foreman et al. | 313/479 |
| 4,229,675 | 10/1980 | Matsuki et al. | 313/479 X |
| 4,528,477 | 7/1985 | Gallaro | 313/479 |

FOREIGN PATENT DOCUMENTS 55-150539 11/1980 Japan .

*Primary Examiner*—Palmer C. DeMeo
*Assistant Examiner*—Sandra L. O'Shea
*Attorney, Agent, or Firm*—John C. Fox

[57] ABSTRACT

A color cathode ray tube having feedback features including a phosphor pattern on the mask and a window in the tube wall to allow external detection of the phosphor emissions, also incorporates arc limiting features including a high resistance coating in the neck region of the tube and a lower resistance coating underneath the arc limiting coating in the region of electrical contact between the arc limiting coating and the electron gun. The composite coating is effective to reduce erosion of the arc limiting coating in the area of snubber contact during high voltage conditioning of the tube. Such a tube is useful, for example, for high resolution color displays having an automatic convergence feature.

6 Claims, 4 Drawing Figures

COLOR CRT WITH COMPOSITE ARC SUPPRESSION STRUCTURE

BACKGROUND OF THE INVENTION

This invention relates to a color cathode ray tube (CCRT) having an arc suppression structure to minimize surge currents from the CCRT caused by internal arcing, and more particularly relates to such a CCRT having a composite internal conductive coating with arc suppression features.

Co-pending U.S. patent application Ser. No. 525,758, filed Aug. 28, 1983, describes and claims a CCRT having certain feedback features making such tube suitable for use with high resolution color displays, having an automatic convergence feature.

CCRT's are known to be susceptible to occasional internal arcing due to their high operating potentials (typically 25 to 30 kilovolts) and small inter-electrode spacings (typically 30 mils). Such arcing results in momentary surge currents up to several hundred amps, high enough to destroy critical components in the external circuitry.

The feedback CCRT of the above-mentioned co-pending Application incorporates certain arc suppression features including a high resistance internal conductive coating in the neck region adjacent the high potential electrodes of the electron gun, and a getter structure designed to result in an effective getter "flash", a deposit of gas-adsorbing material essential to adequate life, without the formation of a conductive bridge across the coating.

High resistance coatings in the neck region are known to be effective "surge limiters" by suppression of arc currents during tube operation. See for example, U.S. Pat. Nos. 2,829,292; 3,555,617; 3,961,221; 3,959,686; 4,249,107; 4,280,931 and German Pat. No. 2,634,102. However, such coatings can hinder high voltage conditioning during tube processing. In high voltage conditioning, a voltage of 40 kilovolts or more is applied between the terminal high voltage electrode and adjacent electrodes of the electron gun to remove projections and foreign matter from the interelectrode spacings. Electrical contact with the high voltage electrode is made by contacting the external surface of the anode button, a high voltage contact which protrudes through a forward portion of the funnel wall to make contact with the internal conductive coating. This coating extends into the neck region, where the circuit is completed by spring-like snubbers, attached to the terminal portion of the gun and making contact with the internal conductive coating.

The snubbers, typically spoon-shaped, and fabricated of spring steel, are usually arranged with the bowl-shaped contact portion extended beyond the terminal portion of the gun. Typically, three such snubbers are attached equidistantly about the periphery of the top cup or convergence cup of the gun. During insertion of the gun into the tube, the snubbers must be deflected inward slightly to clear the neck wall. The bottoms of the bowl-like portions make low-friction sliding contact with the internal coating as the gun is moved into position. Once in position, each snubber makes a firm, essentially point contact with the coating.

During normal tube operation, the current across these point contacts is almost zero. Occasional spurious currents are on the order of a few microamps. However, during high voltage conditioning, the current across these contacts reaches peaks of the order of tens of amps. While the conditioning energy is pulsed, these peak currents are nevertheless apparently of sufficient duration and intensity to cause erosion of the high resistance coating in the area immediately under the contact. In severe cases, such erosion leads to loss of contact and, consequently, tube failure.

It has been suggested to alleviate this erosion problem by placing a lower resistance coating between the snubber and the high resistance coating, thus eliminating the troublesome point contact with the high resistance coating, and providing a larger area of contact through the lower resistance coating. However, this arrangement reduces the effectiveness of the arc suppression feature of the high resistance coating by providing a low resistance path between the coating and the gun, effectively shorting out a significant portion of the arc suppression coating.

SUMMARY

Accordingly, it is an object of the invention to alleviate the erosion of the arc limiting coating during conditioning without compromising the arc limiting capacity of such coating. It is a further object of the invention to alleviate such erosion without substantial changes in either tube design, especially gun design, or tube processing.

In accordance with the invention, it has been found that placing a low resistance coating in the area of snubber contact under the arc-limiting coating substantially relieves the tendency of the arc limiting coating to erode during high voltage conditioning. While the reason for such reduced erosion is not completely understood, it is felt that the placement of the low resistance coating forms a composite structure having less effective resistance, and less tendency toward localized heating than the arc limiting coating alone.

Accordingly, a CCRT incorporates an arc suppression coating in the neck region of the tube, extending into the lower funnel region and making electrical contact with the internal conductive coating in such region, and at least one layer of a third coating of lower resistance than the arc-limiting coating, located between the arc limiting coating and the glass envelope in the area of electrical contact with the terminal portion of the electron gun.

In one embodiment, the third coating forms a continuous band around the inner wall of the neck. In another embodiment, the coating is broken into individual layers, each layer associated with one of a plurality of electrical contacts extending from the terminal portion of the gun.

In accordance with a preferred embodiment, the CCRT also includes feedback features including a phosphor pattern on the back side of the aperture mask, a window in the tube wall to allow external detection of signals from the phosphor pattern, and a getter constructed and located to flash a getter deposit on the tube wall away from the mask, neck and window regions of the tube. Thus, sufficient getter flash is obtained for acceptable tube life, while the arc suppression features as well as the feedback features of the tube are substantially preserved.

DETAILED DESCRIPTION

Figure 1:
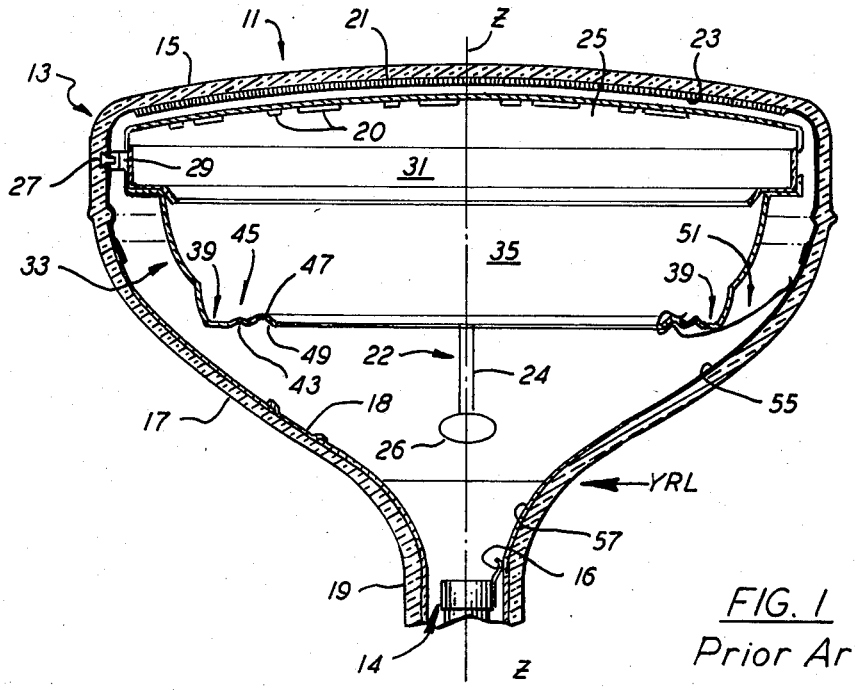
FIG. 1 Prior Art
FIG. 1 is a cross-section of one embodiment of a color cathode ray tube of the prior art with feedback features.

The cathode ray tube 11, shown in FIG. 1, is an exemplary color tube having a longitudinal Z axis and embodying an envelope 13 comprised of an integration of viewing panel 15, funnel 17 and neck 19 portions. Adhered to the inner surface of the viewing panel 15 is a patterned cathodoluminescent screen 21 formed of a multitude of discrete areas of color-emitting phosphor materials. A thin metallized film 23, such as aluminum, is usually applied over the interior surface of the screen and a portion of the sidewall area of the panel. A multi-apertured structure or aperture mask member 25 is spatially related to the patterned screen 21, being positioned within the viewing panel 15 by a plurality of stud-like mask supporting members 27 partially embedded in the panel sidewall in spaced-apart orientation. Mating with these supporting studs are a like number of mask locator means 29 which are suitably affixed to the frame portion 31 of the mask member 25. Mask member 25 directs the electron beams from plural beam electron gun 14 to the desired phosphor elements on screen 21.

Securely attached to the rear portion of the mask frame, as by a plurality of clips or welds, is an internal magnetic shielding member (IMS) 33 for shielding the beams from external stray magnetic fields. This structure, formed of a thin metal such as cold rolled steel, is shaped to evidence a continuous contoured bowl-like sidewall enclosure 35 having front and rear openings. The rear opening in the shielding member 33 is defined by ledge 39 extending inward from the sidewall enclosure 35 towards the Z axis. Narrow channels 43 and 49 formed in the ledge element 39 of the shielding member 33 strengthen the ledge element and also cooperate with contactor member 51 fabricated of a metallic spring material, for example, stainless steel, to effect contact with the conductive coating 55 disposed on the interior surface of the funnel 17.

Coating 55 extends from the forward portion of funnel 17 to the yoke reference line (YRL), which line aids in the proper external placement of the magnetic deflection yoke, not shown. Contiguous internal arc suppression coating 57 extends from the YRL into the neck 19 where it makes electrical contact with gun 14 by way of snubber 16. Coatings 55 and 57 can be abutting, as shown, or overlapping, to achieve the necessary electrical continuity between them. A phosphor pattern on the back of mask 25, denoted by elements 20, emits radiation toward the rear of the tube upon being struck by electron beams from gun 14. Window 18 in coating 55 passes some portion of this radiation to an externally placed detector such as a photomultiplier tube.

Metallic getter assembly 22 includes getter wand 24 attached to IMS 33 and getter container 26 attached to wand 24, containing a getter material to be flashed during tube manufacture. Getter materials and flash techniques are well known in the art. Getter materials are primarily barium compounds and are conventionally flashed by placing an RF heating coil near the outside wall of the funnel adjacent the getter container after the tube has been exhausted and sealed, and heating to vaporize the material. The getter assembly 22 can be attached to the shield 33 prior to frit sealing of the mask-shield-face panel assembly to the funnel, in which case a "bakable getter" able to withstand frit sealing temperatures is employed. Alternatively, the getter assembly 22 can be attached after frit sealing by inserting through neck 19 and clipping onto shield 33, in which case a conventional non-bakable getter may be employed.

Coating 55 is preferably of the conventional "hard dag" type, composed of finely divided graphite, iron oxide, an alkali metal silicate binder and a dispersant. Such a coating will typically exhibit a static resistance (measured point-to-point when the tube is non-operational) in the range of about 600 to 1500 ohms, depending upon a variety of factors such as coating composition, thickness, uniformity, etc. The coating may be brushed, sprayed, or flowed onto the funnel, although flow coating requires a well-dispersed, non-viscous composition. Window 18 is preferably formed prior to application of coating 55, by application of a material such as tin-antimony resinate, and by baking to convert the resinate to oxide. Window 18 is kept clear by adhering a temporary mask to it prior to applying the coating 55. After the coating has dried, the mask is removed.

Coating 57 is an arc limiting coating and thus exhibits a higher static resistance than coating 55, for example, 2,000 ohms to 1 megohm ($10^6$ ohms), but preferably 3,000 to 6,000 ohms. A variety of suitable arc limiting coatings are known, such as metal oxide-containing frit compositions and modified dag compositions, some of which are referenced herein, in which the iron oxide may be replaced by other metal oxides such as chromium oxide, aluminum oxide and titanium dioxide, and the oxide-to-graphite ratio may be increased. Any of these compositions are suitable for use in the invention provided they exhibit resistance values within the desired range. While coatings with resistances up to one megohm may be used, it is preferred to employ coatings with resistances which do not exceed about 6,000 ohms, above which high voltage conditioning is difficult to achieve without risking damage to internal tube components.

Figure 2:
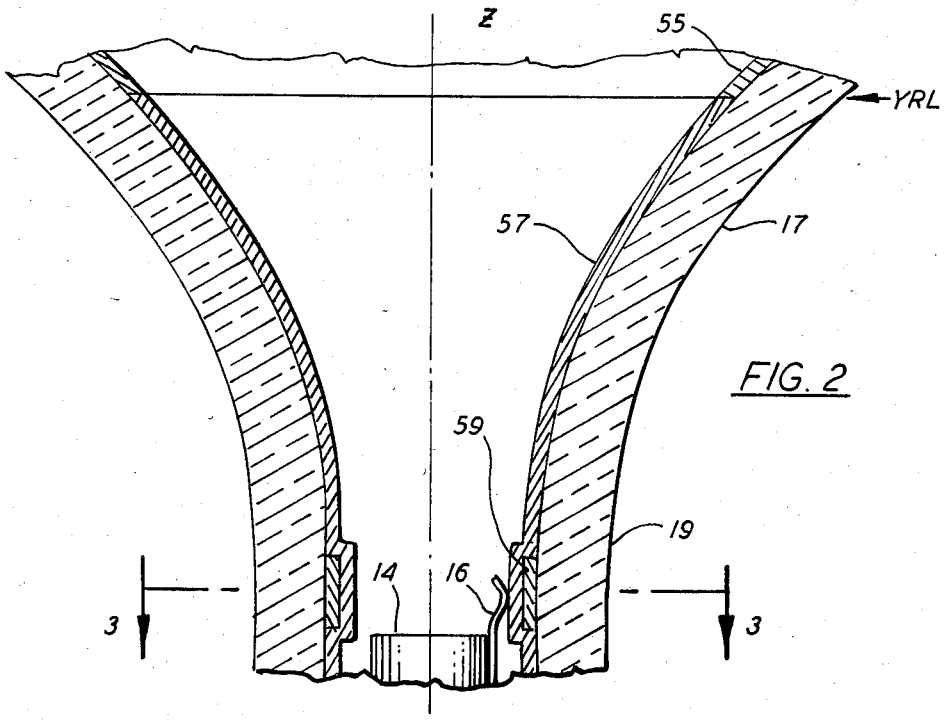
FIG. 2 is an enlarged portion of a tube similar to that of FIG. 1, detailing a composite internal coating according to one embodiment of the invention.

Referring now to FIG. 2, there is shown an enlarged section view of a portion of a tube similar to that of FIG. 1, showing a third coating 59 of lower resistance than that of coating 57. Such coating 59 is in the form of a continuous band of material located between the coating 57 and neck portion 19 of the tube envelope, in the area of contact between coating 57 and snubber 16. This third coating is preferably of the same hard dag composition which is used for coating 55, but could of course be of other compositions which yield a compatible, adherent coating of lower resistance than arc limiting coating 57.

Snubber 16 is made of a metallic spring material such as stainless steel, and has two portions, an elongated spring-like base portion **16*a* and a bowl-shaped terminal contact portion 16*b*. Snubber 16 is attached, for example by spot welding snubber base 16*a* to a sidewall of the top cup or convergence cup of gun 14, and is oriented to extend upward and outward with the open side of contact portion 16*b* facing inward. Snubber 16 is flexed inwardly to provide clearance upon insertion of the gun assembly into neck 19. The resulting spring bias of snubber 16 insures firm electrical contact of portion 16***b* with arc-limiting coating 57. In addition to providing contact, portion 16*b* allows the gun assembly to slide along coating 57 during insertion into the tube.

Figure 3:
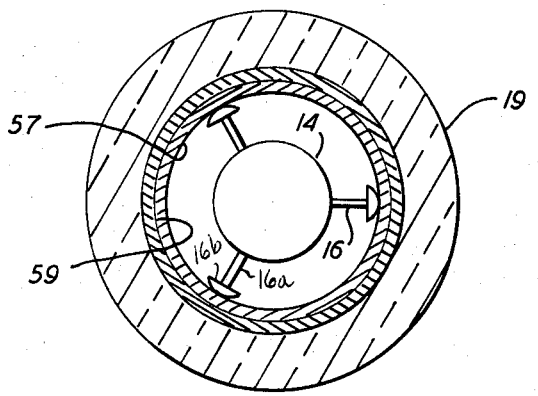
FIG. 3 is a section view, taken along section 3—3, the tube of FIG. 2.

Referring now to FIG. 3, a section view 3—3 of the tube of FIG. 2, there is shown coating 59 as a single layer or band of coating material underneath arc limiting coating 57.

Figure 4:
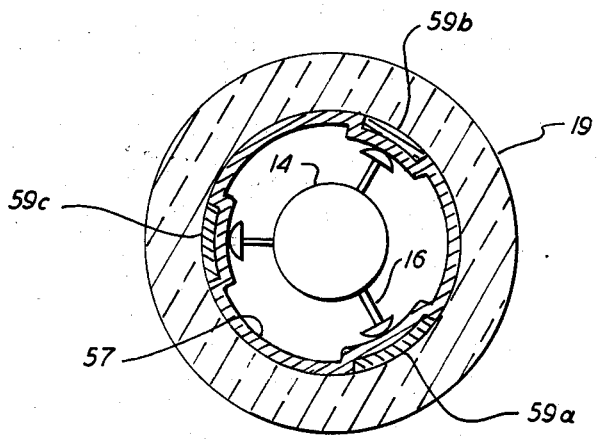
FIG. 4 is a section view similar to that of FIG. 3, illustrating another embodiment of the invention.

Referring now to FIG. 4, a section view similar to that of FIG. 3, there is shown another embodiment of the invention in which the third coating is divided into three individual layers 59*a*, 59*b* and 59*c*, each layer associated with one of three snubbers located equidistantly about the periphery of gun 14. While such layers must be placed with sufficient accuracy to be located under the snubber contact points, this embodiment may be advantageous not only in using less material, but also in adding less capacitance to the tube structure in the region of the deflection yoke as compared to the embodiment of FIGS. 2 and 3.

While there have been shown and described what are at present considered the preferred embodiments of the invention, it will be obvious to those skilled in the art that various changes and modifications may be made therein without departing from the scope of the invention as defined by the appended claims. For example, the described arc limiting composite coating, while especially useful in CCRT's having feedback features, may also benefit conventional CCRT's without such feedback features.

What is claimed is:

1. A color cathode ray tube comprising a glass envelope of integrated neck, funnel and face panel regions, a plural beam electron gun in the neck portion, said gun having a terminal portion including at least one electrical contact means, a phosphor screen having a plurality of phosphor elements on the interior surface of the face panel portion, an aperture mask adjacent the screen for directing the electron beams to the desired phosphor elements, and a composite conductive coating on the interior surface of the glass envelope to provide electrical connection between the terminal portion of the gun and the mask, the composite conductive coating comprising a first coating substantially in the forward portion of the funnel region of the tube and a second arc suppression coating in contact with the first coating and extending substantially into the neck region of the tube, characterized in that:

the composite conductive coating further includes at least one layer of a third coating located beneath the second arc suppression coating, substantially in the area in which the second coating makes electrical contact with the gun, the first and third conductive coating exhibiting a static resistance of from about 600 to 1500 ohms, and the second conductive coating exhibiting a static resistance of from about 2000 ohms to 1 megohm.

2. The color cathode ray tube of claim 1 wherein the third coating comprises a single layer of a continuous band extending completely around the interior surface of the neck.

3. The color cathode ray tube of claim 1 wherein the terminal portion of the gun includes a plurality of electrical contact means, and the third coating comprises a plurality of layers, each layer associated with one of the electrical contact means.

4. The color cathode ray tube of claim 1 wherein the second conductive coating exhibits a static resistance of from about 3000 to 6000 ohms.

5. The color cathode ray tube of claim 1 wherein the electrical contact means comprises a metallic spoon-shaped element having an elongated spring-like base portion, the base portion attached to the terminal portion of the gun, and a bowl-shaped terminal contact portion for making point contact with the arc limiting coating.

6. The color cathode ray tube of claim 1 having a phosphor pattern on the gun side of the mask, a conductive window in the conductive coating on one side of the funnel to allow external detection of emissions from the mask phosphor, an internal magnetic shield attached to the mask for shielding the beams from external stray magnetic fields, and a getter assembly for flashing a getter deposit inside the tube, the getter assembly comprising a getter container and wand, the container in contact with the first conductive coating, and attached to the shield by the wand.

* * * * *